US005865136A

United States Patent [19]

Alexander

[11] Patent Number: 5,865,136

[45] Date of Patent: Feb. 2, 1999

[54] SYSTEM FOR LIFTING AND LOWERING A SAILBOAT MAST

[76] Inventor: William A. Alexander, 1133 SE. Second St., Grand Prairie, Tex. 75051

[21] Appl. No.: 97,274

[22] Filed: Jun. 15, 1998

[51] Int. Cl.[6] ..... B63B 15/00

[52] U.S. Cl. ..... 114/91; 114/39.1

[58] Field of Search ..... 114/39.1, 90, 91, 114/98

[56] References Cited

U.S. PATENT DOCUMENTS 3,898,948 8/1975 Huff ..... 114/91

4,259,917 4/1981 Frank ..... 114/91

4,655,154 4/1987 Leonard ..... 114/91

*Primary Examiner*—Jesus D. Sotelo

*Attorney, Agent, or Firm*—Robert H. Frantz

[57] ABSTRACT

The inventive system and method provides a portable sailboat mast hoisting crane which is safe, light weight, easily assembled, easily disassembled, and operable by one man. The crane can be locked down for security on the frame of the boat trailer for storage. The mounting mechanism is universally compatible with most pleasure craft sailboats, and does not require alternation or permanent modifications to the vessel.

16 Claims, 6 Drawing Sheets

60
49
42
45
62
4
51
15

SYSTEM FOR LIFTING AND LOWERING A SAILBOAT MAST

TECHNICAL FIELD OF THE INVENTION

This invention relates to hoisting devices employed on naval vessels. More particularly, this invention relates to a system to enable a single man to hoist a mast on a sailboat safely and easily without need for great physical strength or agility. The hoist is adapted for non-permanent installation on most pleasure craft sailboats.

BACKGROUND OF THE INVENTION

Most pleasure craft sailboats have a mast which can be lowered from the upright and vertical position to a horizontal position. With the mast in the horizontal position, the boat can be stored in a low-ceiling protective enclosure, and can be moved over land on a trailer without having the mast interfere with power lines and bridges over roadways. It is desirable for many boat owners to trailer their sailboat to land-based storage to avoid costly water-based marina storage fees.

However, most masts of medium to large size sailboats are fairly heavy, and can require three or more men to lift them into the upright and vertical position before launching the craft from the trailer to the water. For example, a 24-foot mast weighs approximately 200 pounds in the vertical position, and can reach over 30 feet in height from ground level when in the upright position. This initial weight can be difficult and dangerous for one or even two men to lift, and the righted height can interfere with overhead power lines unintentionally.

Correspondingly, to safely lower the mast on the vessel, several men may be required again. This need for several men to "put in" and "take out" the craft reduces the independence of the boat owner who may want to sail alone, and can cause considerable safety risk to all involved during the lifting and lowering operations.

Most sailboats do not have a common method for mounting deck accessories such as wenches and hoists, so mounting an "after market" mast wench to the deck of sailboats presents a particularly challenging problem.

Therefore, there exists a need in the art to provide a lifting apparatus to allow a single man of normal human strength and agility to raise and lower a sailboat mast from and to the horizontal storage position to and from the upright and vertical position.

Furthermore, there exists a need in the art for this system and method to enhance the safety of the operator of the system over the prior art method of manual lifting and lowering.

Finally, there is a need in the art for this system and method to be easily installed and removed to and from a sailboat, without need for permanent mounting modifications or fixtures to the vessel.

SUMMARY OF THE INVENTION

The object of the present invention is to allow a lone sailboat owner or operator to lift and lower the mast to and from horizontal and vertical positions without need for additional manual assistance.

Another object of the invention is to enhance the safety of the mast lifting and lowering operation by allowing the process to be stopped, held, and reversed at any point in the operation.

Another object of the invention is to provide a mounting scheme for the mast hoist which is universally applicable to most sailboats, able to be installed and removed by a single person, and does not require permanent modification of the vessel deck or hardware.

A further object of the invention is to allow construction of the hoist device using common, low cost, and light weight materials, with as many common subassemblies as possible to reduce manufacturing cost and maximize portability of the unit.

BRIEF DESCRIPTION OF THE DRAWINGS

For a more complete understanding of the invention.

Finally, FIG. 6 shows a side view of the left door bracket assembly to illustrate details of its construction.

DETAILED DESCRIPTION OF THE INVENTION

In accordance with the objects of the invention set forth in the Summary of the Invention, the sailboat mast hoist system allows a single operator to lift and lower a sailboat mast without assistance from other crew members, while providing a safe mechanism to halt the lifting or lowering operation at any point and reverse the operation.

The mounting mechanism for the hoist does not require permanent installation to the boat or modification of the boat deck. It is designed to be lightweight and portable, allowing the lone operator to quickly install the hoist, raise or lower the mast, and remove the hoist for stowage.

To enhance the marketability of the device, the hoist system is constructed using common materials and common subassemblies.

Figure 1:
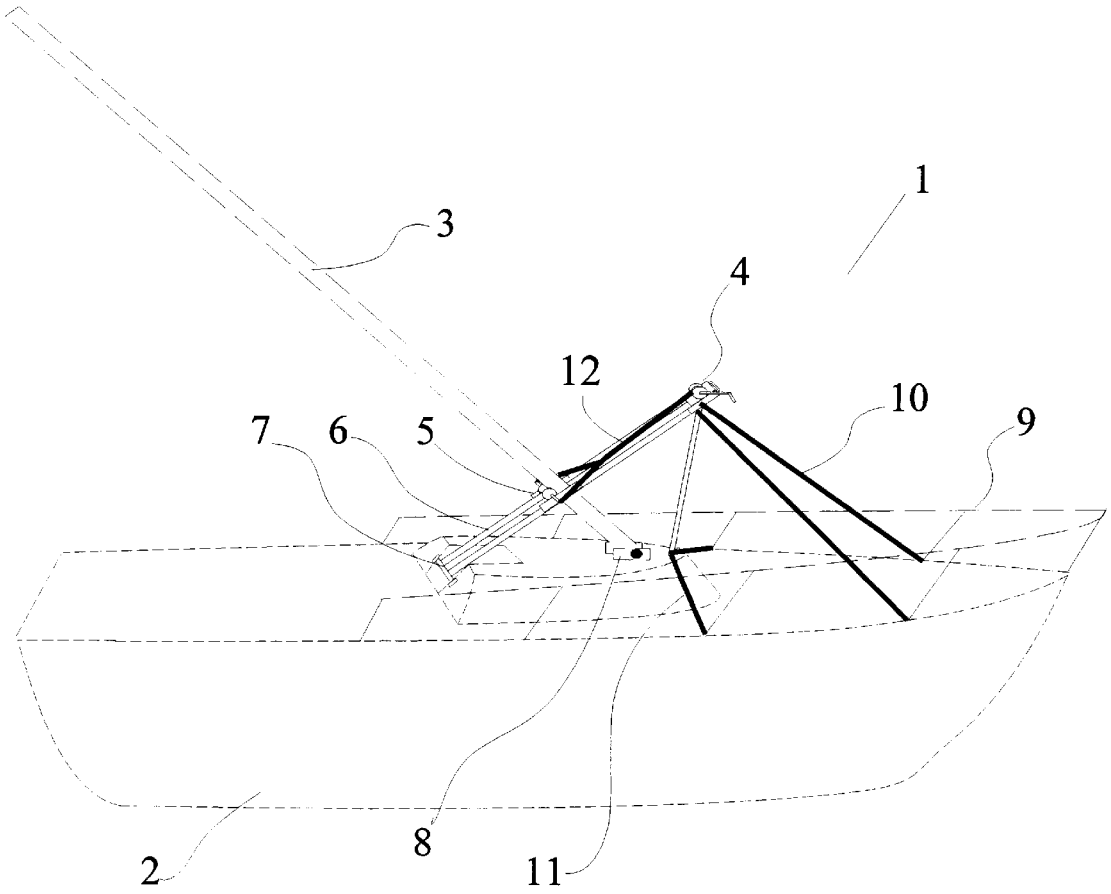
FIG. 1 shows a side view of the entire hoist system mounted to a typical sailboat.

Turning to FIG. 1, the entire system (1) is depicted mounted to a typical sailboat. A mast (3) is attached to the sailboat (2) on a pivoting bracket (8) usually on the cabin roof or the boat deck. These components are part of a typical sailboat, and are well known in the art. When the boat is stored or on a trailer, the mast (3) is lowered to the horizontal position. The mast (3) is raised to the upright and vertical position just before launching the sailboat (2) and during actual sailing.

The inventive system (1) mounts to the typical sailboat (2) and mast (3) as shown in FIG. 1. At the top of the system is a wench subsystem (4), located at the top end of two hoist rails (6). Mounted below the mast is the hoist train (5), which slides along the rails (6) to lift or lower the mast (3). The wench subsystem (4) pulls the train (5) closer to it, raising the mast, or lowers the train (5) away from it, lowering the mast, via a cable or chain system (12) between the wench (4) and the train (5).

Critical to the design and safety of the system are the stabilizing chains (10 and 11) which attach to the wench subassembly (4) and the foot of the support leg. The stabilizing chains are connected to fence rail posts or cleats and tightened. After connection to the cleats or fence rail posts, they are tightened or tensioned. During a lift or lower operation, they provide side-to-side stability against sway and possible tip-over of the mast and hoist. The particular design of these stabilizing chains places all structural members of the hoist in compression, which reduces the strength of the materials necessary for those members to perform their function adequately.

Figure 2:
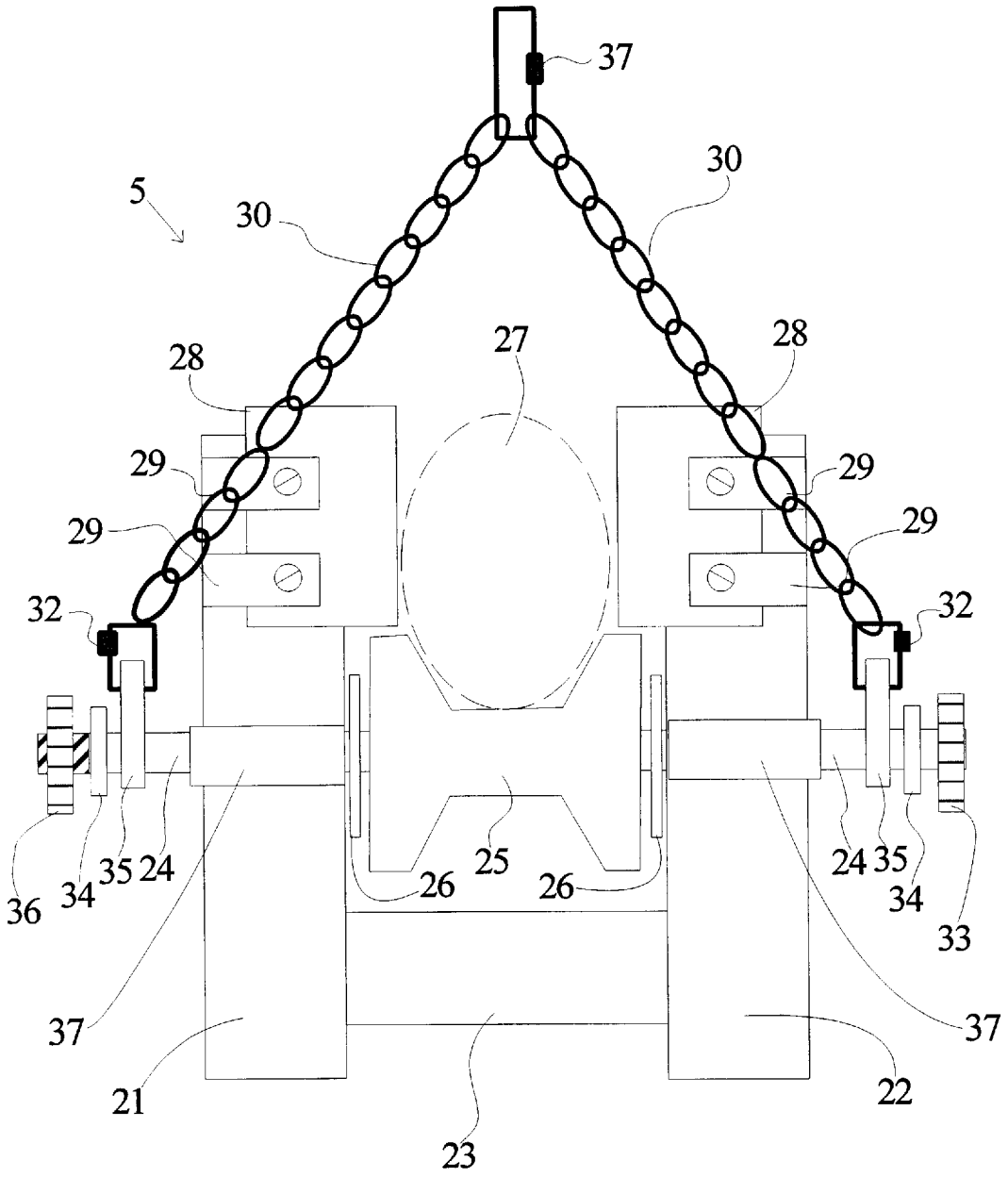
FIG. 2 shows the train unit of the inventive hoist. The train is the portion which contacts the sailboat mast and lifts or lowers the mast during operation, sliding along the train rails.

Turning now to FIG. 2, details of the hoist train (5) are shown. The basic frame of the hoist train consists of two longitudinal members (21 and 22), connected by a cross member (23) to form a U-shaped frame. In the preferred embodiment, these are constructed of squareshaped aluminum tube sufficient for the weight and stress. This allows the train to have a maintenance-free polished or brushed finish, and reduces the weight and cost of the unit. Alternatively, the frame may be constructed of plated or painted steel, fiberglass, or suitable plastic, and may be square or round. All of these alternatives are known in the art and do not represent a departure from the spirit of the invention. Most importantly, they are of a size of inside diameter suitable for mounting the hoist rails (6) through, allowing the train assembly (5) to slide up and down the hoist rails (6).

In the center of the U-shaped frame of the train assembly (5) is a roller (25) on an axle (24). This roller (25) can be a common rubber, plastic, metal, or fiberglass roller rated for the stress of supporting the sailboat mast (27). A hard rubber or plastic roller is used in the preferred embodiment to eliminate possible surface marring or damage to the mast over years of use. The roller (25) receives the mast (27) to lift and lower the mast. At non-vertical positions, the mast (27) cross section is elliptical, as shown in FIG. 2.

The axle (24) can be constructed several ways known in the art, but in the preferred embodiment, a steel bolt is used with a nut (36) and washer (34) to hold it in place, with bushings (37) mounted external to the longitudinal U-frame members (21 and 22). The bushings (37) may be welded to the frame members (21 and 22), or may be attached by other methods well known in the art. Flanking the roller (25) on either side of the roller and between the roller and the frame members (21 and 22) are two washers (26), which can be steel, brass, or nylon.

Attached to each of the longitudinal U-frame members (21 and 22) are mast sliding guides (28). The mast sliding guides keep the mast (27) centered on the roller (25), especially when the mast position is less than vertical. These are preferably constructed of square or round wood, but may also be constructed of any non-abrasive, low-friction material such as tubular steel, aluminum, fiberglass, or plastic. The mast sliding guides (28) can be mounted to the frame members (21 and 22) using many methods well known in the art such as welding, glue, rivets, etc. FIG. 2 shows a use of straps and screws (29) for this purpose.

The train (5) is pulled by the wench subassembly (4) by the use of a Y-shaped cable or chain (10 in FIG. 1). FIG. 2 shows the use of chain (30), and removable chain links (37 and 32) to form the V-portion, or yoke, of the Y-shaped cable assembly. A single chain or cable can be attached to the removable link (37) from the wench subassembly. The ends of the chain can be attached to the axle using a variety of well-known components, such as a steel ring (35) as shown in FIG. 2. Alternatively, the cable and yoke can be assembled using steel or fiberglass cable with permanent clamps to form loops, thereby eliminating the need for the removable links (37 and 32).

Figure 3:
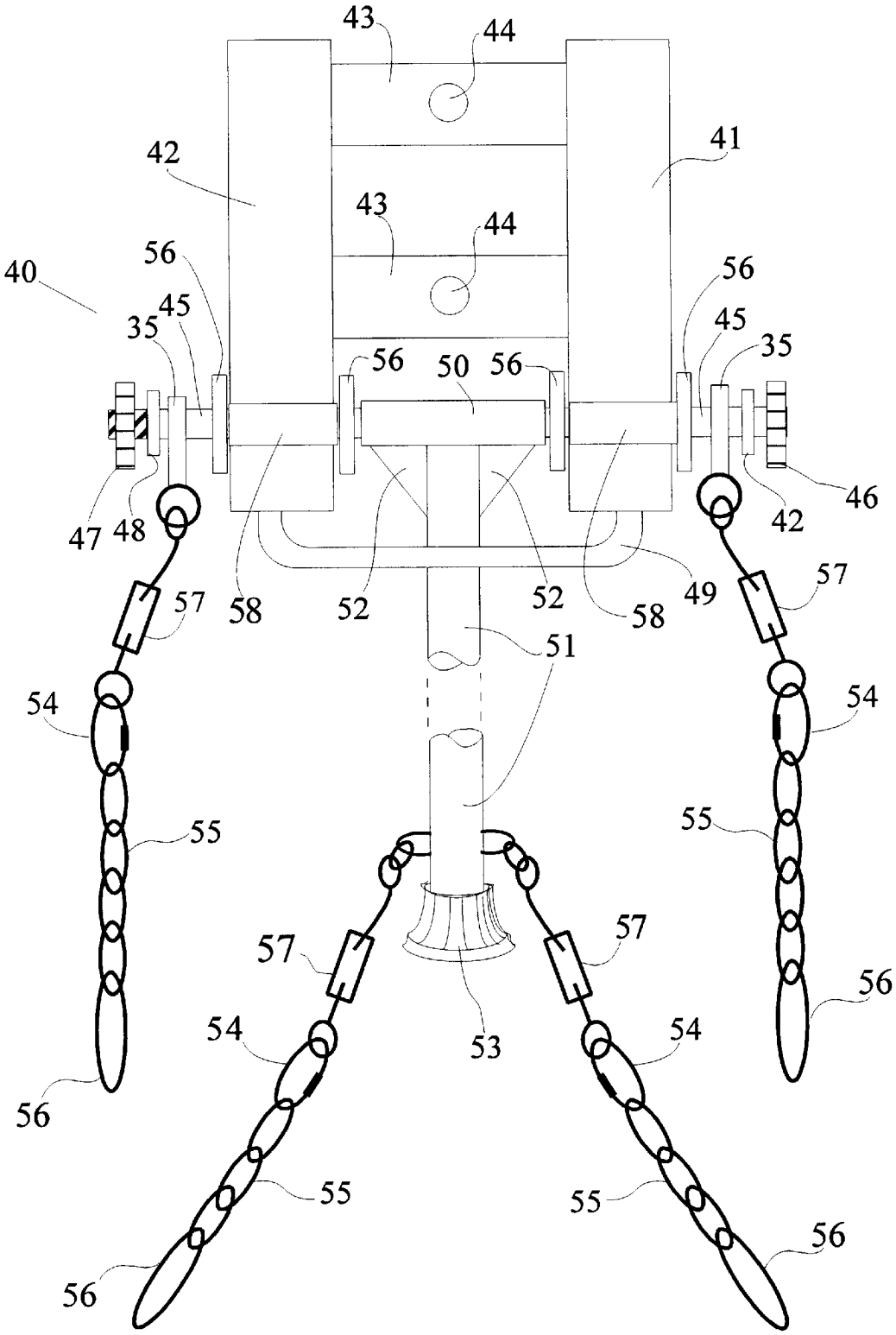
FIG. 3 shows the mounting stand for the wench of the hoist.

The wench subassembly (4) is designed to use a common wench such as that found on the front of typical boat trailers. FIG. 3 shows a wench platform assembly (40) designed to accommodate such a common wench. The frame of the wench platform is constructed of square or round tubing made of steel, aluminum, fiberglass, or plastic, similar to the construction of the train frame discussed earlier. Again, in the preferred embodiment, steel or aluminum is recommended. The frame consists of two longitudinal members (42 and 41) of sufficient inside diameter to snugly fit over the hoist rails (6). A stabilizer bar (49) is attached across the ends of the frame members (41 and 42) to strengthen the assembly and form a detente for the frame when mounted on the hoist rails (6). The wench frame is completed with two cross members (43), each having a mounting hole (44) for the common wench attachment. Mounted to the longitudinal frame members (41 and 42) is another axle (45), which can be constructed similarly to the axle of the train subassembly. FIG. 3 shows the use of a steel bolt (42), nut (47) and washer (48) for this purpose, with bushings (58) welded to the longitudinal members (41 and 42).

On the axle (45) is mounted a T-shaped round tubular support leg (50 and 51) with cross supports (52). This support leg forms the physical support between the wench subassembly (4) and the deck of the boat. It is recommended to place steel or brass washers (56) between the frame members (41 and 42) and the top of the support leg (50). To keep the foot of the support leg (51) from slipping on the deck and to avoid the need for permanent mounting hardware on the boat deck, a non-slip rubber or nylon end cap (53) is placed on the end of the leg.

The support leg must be further stabilized by the use of a stabilizer chain or cable assembly, as shown in FIG. 3 as chain (55), removable chain links (54), tumbuckles (57), and snap rings (56). The removable links (54) provide an easy method of assembly and disassembly. The snap rings are used to secure the end of each stabilizer chain or cable to a fence rail post or cleat on either side of the sailboat. The tumbuckles (57) are turned to tighten or loosen the tension on the stabilizer chain.

Similarly, the wench platform must be stabilized, too. Similar stabilizer chain or cable assemblies must be installed to keep the hoist and mast from possibly tipping over during the raising and lowering operations. The chains again utilize chain (55), removable chain links (54), turnbuckles (57), and snap rings (56). In this case, though, it is important that the securing points on the boat for the snap-ring ends of the chains be to the bow, or forward, of the foot of the support leg (53) in order to provide the proper stabilizing force magnitude and vector. For any of these stabilizer chains, actual chain, steel, or fiberglass cable may be used, but steel chain is the preferred material.

Figure 4:
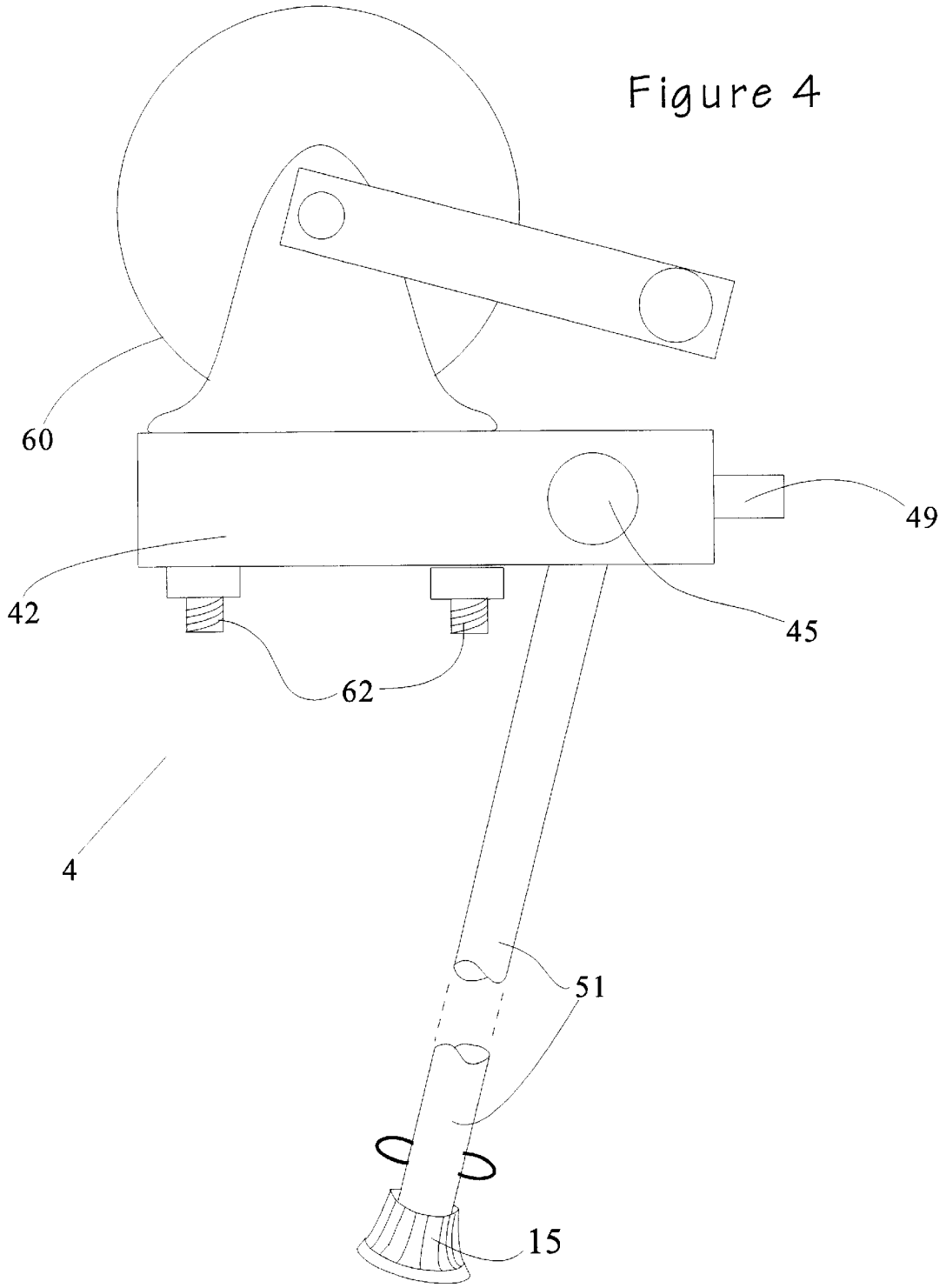
FIG. 4 shows a side view of the hoisting crane wench and stand. The wench is the unit that provides the lifting power through gearing for an individual to lift and lower the heavy mast.

FIG. 4 shows a side view of the wench subassembly (4) with a typical wench unit (60) mounted to the wench platform frame using two bolts and nuts (62) through the holes (44) in the frame cross members (43).

Figure 5:
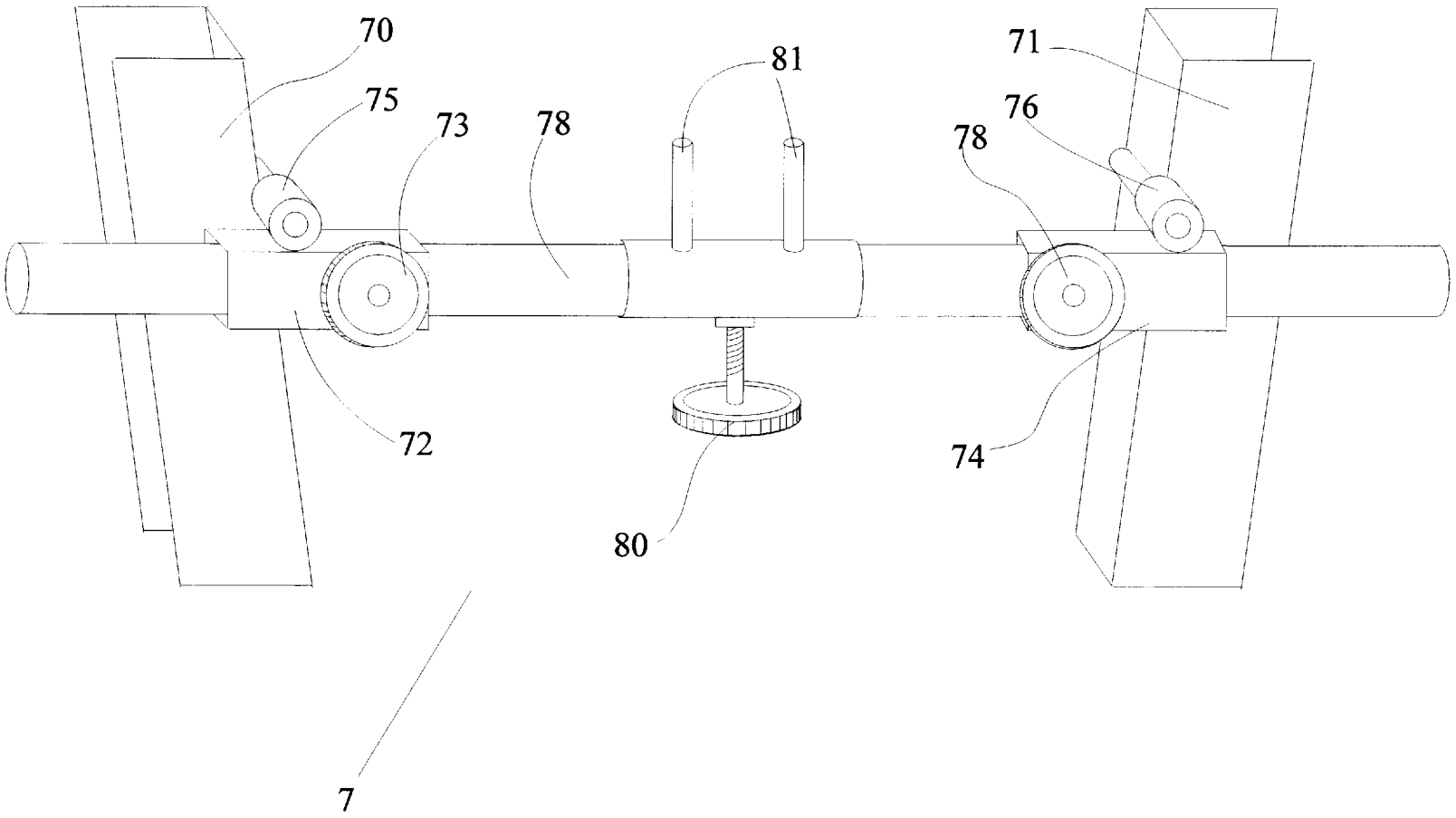
FIG. 5 shows the adjustable anchor bracket for the trail rails, which installs in a upward V-shaped sailboat cabin door opening.

Turning finally to the hoist system adjustable mounting bracket (7) for the sailboat cabin door frame. Typical sailboats have a slightly V-shaped cabin door opening. The inventive system takes advantage of this common design feature of sailboats, and utilizes it to allow universal mounting to boats without need for mounting hardware on the boat FIG. 5 shows the entire mounting bracket subassembly (7).

The cabin door frame is captured by two U-shaped brackets (70 and 71) on the left and right of the subassembly (7). They are separated by a bar (72), and pivotally mounted to the bar through the bar guides (73 and 74) and the pivot pins (75 and 76). The pivotal adjustment allows the brackets (70 and 71) to tilt to the appropriate angle of the cabin door frame. Width adjusting knobs (78) retain the brackets at a given spacing from each other corresponding to the cabin door width, and allow for easy manual adjustment and release from the door frame. Mounted in the center of the bar (72) is the rail foot (79), which is provided with two mounting pins (81) on which the hoist rails (6) are mounted. A rail position adjustment knob (80) is recommended to help hold the foot in place during hoist installation and removal.

Figure 6:
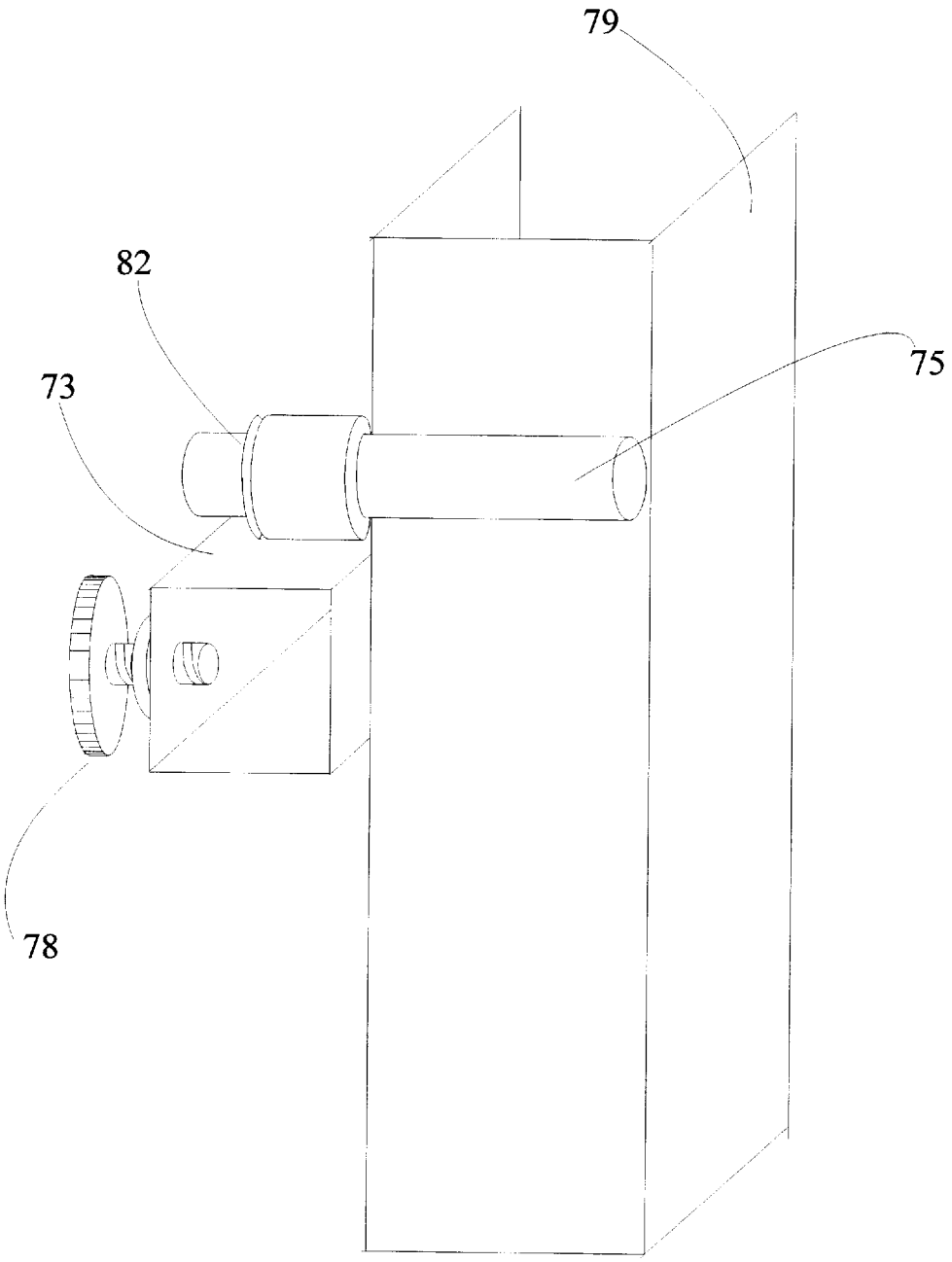
FIG. 6 shows a side view of the left bracket, which is symmetrically repeated for the right bracket.

FIG. 6 shows a side view of the left-hand door bracket assembly. The pivot pin (75) can be constructed using several techniques well known in the art. In the preferred embodiment, and steel rod is used for the pin, with a snap ring (82) in a groove on the rod (75) to keep the bar guide (73) from slipping off of the pivot rod. The other end of the pivot rod (75) can be welded to the door bracket (70). The side view of the bar guide (73) shows how a common method of using a threaded-shank adjustment knob (78) can be used to contact the bar (72) and hold the bracket subassembly in place along the bar. The right-hand door bracket is constructed similarly, in a mirror-image manner to the left-hand door bracket.

When taken in consideration together, the detailed description and figures presented herein describe a sailboat hoisting system which allows a single operator to raise and lower the mast, enhances the safety of the raising and lowering operations, and allows easy installation and removal of the hoist without need for permanent modifications to the boat deck. It is also designed to use common components to lower manufacturing costs, and with an inventive mounting system which allows a single embodiment to be mounted on many different boat designs. Even though detailed embodiment details are given herein, it will be understood by those well-versed in the art that many construction alternatives exist, and using any of those alternative constructions does not depart from the spirit and scope of this invention.

What is claimed is:

1. A hoist system for raising and lowering a sailboat mast operable by a single person, comprised of:

a removable mounting bracket for securing the base of the hoist system in the cabin doorway of the sailboat;

two parallel rails between which the mast to be raised or lowered is disposed, each rail having an upper end and a lower end, said lower ends of both rails being securely attached to said removable mounting bracket in the cabin doorway of the sailboat;

a train assembly slidably mounted to said two parallel rails, said train having a roller means for contacting and lifting the sailboat mast, and said train also having a first cable attachment means;

a lifting cable having a first and a second end, said first lifting cable end being attached securely to said train assembly first cable attachment means; and a wench assembly securely mounted on the upper ends of said parallel rails opposite of said mounting bracket, said wench assembly having a support leg disposed between the wench assembly and the deck of the sailboat, said wench assembly having a second cable attachment means securely attached to said second lifting cable end, said wench providing lift force to said lifting cable, said lift force being transferred by said lifting cable to said train assembly causing the train assembly to ascend or descend said parallel rails, thereby lifting and lowering the sailboat mast.

2. The hoist system of claim 1, wherein said wench assembly further comprises:

two lower stabilizing cables, each of the lower cables having two ends, both of said two lower cables being affixed at one end to the deck end of said support leg, the other end of each said lower stabilizing cables being connected to points on the deck of said sailboat on opposite sides of the sailboat, each of said lower cables having a tension setting means; and two upper stabilizing cables, each of the upper cables having two ends, both of said two upper cables being affixed at one end to the wench end of said support leg, the other end of each said upper stabilizing cables being connected to points on the deck of said sailboat on opposite sides of the sailboat and to the bow of the position of the deck end of said support leg, each of said upper cables having a tension setting means.

3. The hoist system of claim 2, wherein said upper and lower stabilizing cables are comprised of chain.

4. The hoist system of claim 2, wherein said upper and lower stabilizing cables are comprised of cable.

5. The hoist system of claim 2, wherein said tension setting means are comprised of turnbuckles.

6. The hoist system of claim 2, wherein said tension setting means are comprised of ratcheting come-along devices.

7. The hoist system of claim 2, wherein said points of connection of said upper and lower stabilizing cables on the boat deck are fence rail posts.

8. The hoist system of claim 2, wherein said points of connection of said upper and lower stabilizing cables on the boat deck are cleats.

9. The hoist system of claim 1, wherein said wench assembly further comprises:

a support leg having an upper and a lower end, said support leg lower end contacting the deck of the sailboat;

a wench device mounting platform securely mounted on said upper end of the support leg; and a wench unit, said wench unit being securely affixed to said second end of the lifting cable and providing lift force to the cable and train.

10. The hoist system of claim 9 wherein said wench unit is a manual crank-style wench device.

11. The hoist system of claim 9 wherein said wench unit is an electric motor wench device with forward and reverse controls for controlling the mast lifting and lowering operation.

12. The hoist system of claim 9 wherein said wench unit is a spring-loaded device, said spring being wound by the action of lowering the mast and storing energy in the spring, and said lifting force to return the mast to the upright position being derived from the release of the stored energy in the spring.

13. The hoist system of claim 1 wherein the removable mounting bracket for securing the system in the sailboat cabin doorway further comprises:

a left doorframe U-shaped bracket for engaging the left-hand edge of the doorframe, said left bracket having a left pivot pin;

a right doorframe U-shaped bracket for engaging the righthand edge of the doorframe, said right bracket having a right pivot pin;

a bracket bar, disposed horizontally to said left and right brackets;

a first and second bracket bar guide means, each guide means having a slidable receiving means for receiving said bracket bar, each guide means having a pivot pin receiving means for receiving said left and right pivot pins such that said left doorframe bracket is pivotally mounted to said first bracket bar guide means and said right doorframe bracket is pivotally mounted to said second bracket bar guide means, and said first and second guide means having a detente device to engage and hold the bracket bar in position relative to the left and right doorframe brackets such that the distance between said left and right doorframes is set to match the width of the sailboat cabin doorway.

14. The hoist system of claim 13 wherein the removable mounting bracket detente devices are comprised of bolts mounted through holes drilled in said bracket bar at predetermined locations and spacings.

15. The hoist system of claim 13 wherein the removable mounting bracket detente devices are comprised of latches which frictionally engage the bracket bar to hold it in place.

16. The hoist system of claim 13 wherein the removable mounting bracket detente devices are comprised of hand-actuated adjustment knob assemblies, said knob assemblies having a knurled knob for manual manipulation and a threaded shank such that turning the knob frictionally engages and disengages the bracket bar to hold it in place and to release it.

* * * * *